United States Patent [19]

Nakayama et al.

[11] Patent Number: 4,994,342

[45] Date of Patent: Feb. 19, 1991

[54] ELECTROPHOTOGRAPHIC LITHOGRAPHIC PRINTING PLATE PRECURSOR AND A METHOD OF DEVELOPING THE SAME

[75] Inventors: Takao Nakayama; Chikashi Ohishi; Chiaki Kawamoto; Hidefumi Sera; Sho Nakao, all of Shizuoka, Japan

[73] Assignee: Fuji Photo Film Co., Ltd., Kanagawa, Japan

[21] Appl. No.: 374,816

[22] Filed: Jul. 3, 1989

[30] Foreign Application Priority Data

Jul. 1, 1988 [JP] Japan ..... 63-162630
Sep. 14, 1988 [JP] Japan ..... 63-228379

[51] Int. Cl.[5] ..... G03G 13/26

[52] U.S. Cl. ..... 430/49; 430/64; 430/89

[58] Field of Search ..... 430/49, 62, 60, 64, 430/89

[56] References Cited

U.S. PATENT DOCUMENTS 4,599,288 7/1986 Fuchizawa et al. ..... 430/49
4,882,248 11/1989 Yamada et al. ..... 430/49

*Primary Examiner*—John Goodrow
*Attorney, Agent, or Firm*—Sughrue, Mion, Zinn, MacPeak & Seas

[57] ABSTRACT

An electrophotographic lithographic printing plate precursor capable of giving a good image free from pinholes is provided which comprises an electrically conductive base coated, on one side thereof, with an undercoated layer and a photoconductive layer containing zinc oxide as a predominant component in order and on the opposite side thereof, with a back layer, said undercoated layer having a surface resistivity of $1\times10^{8}$ to $1\times10^{14}\Omega$ and said back layer having a surface resistivity of at most $1\times10^{10}\Omega$.

20 Claims, 3 Drawing Sheets

ELECTROPHOTOGRAPHIC LITHOGRAPHIC PRINTING PLATE PRECURSOR AND A METHOD OF DEVELOPING THE SAME

BACKGROUND OF THE INVENTION

1. Field of the Invention

This invention relates to an electrophotographic lithographic printing plate precursor and a developing method of the same and more particularly, it is concerned with an electrophotographic lithographic printing plate precursor which is suitable for not only the ordinary developing methods but also the developing methods of direct electron injection system and which is capable of obtaining a pinhole-free image and a developing method of the same.

2. Description of the Prior Art

Up to the present time, there has generally been employed an electrophotographic process for the production of a lithographic printing plate precursor comprising subjecting the photoconductive layer of an electrophotographic lithographic printing plate precursor (which will hereinafter be referred to as "master") to uniform static charge, to imagewise exposure and then to liquid development with a liquid toner to obtain a toner image, then fixing this toner image and processing with an oil-desensitizing solution (etching solution) to render hydrophilic a non-image area free from the toner image.

As the base of the above described master, paper rendered electrically conductive has hitherto been used, but this paper base tends to be penetrated with water, resulting in bad influences upon the printability and photographic properties. That is, the paper base is penetrated with the above described etching solution or dampening water during printing and expanded so that the photoconductive layer sometimes separates from the paper base to lower the printing durability, and the moisture content of the paper base is varied with the temperature and humidity conditions in carrying out the above described static charge or imagewise exposure so that the electric conductivity is varied to affect unfavorably the photographic performances.

In order to solve these problems, it has been proposed to coat the one or both surfaces of a paper base with, for example, an epoxy resin or ethylene-acrylic acid copolymer having water resisting property (Japanese Patent Laid-Open Publication Nos. 138904/1975, 105580/1980 and 68753/1984) or to provide with a laminated layer of polyethylene or the like (Japanese Patent Laid-Open Publication Nos. 57994/1983 and 64395/1984).

On the other hand, the above described liquid development has generally been carried out by allowing a developing liquid DL to flow between electrodes 10 and 11 and a master P to pass through the developing liquid DL, as shown in FIG. 3.

In this developing system, however, movement of negative ions in the liquid toner, i.e. developing liquid (negative ions of a polymer added so as to control the charge (+) of a toner in the developing liquid DL, i.e. charge controlling agent) is slow and accordingly, the speed of the negative ions adhering to the surface of a substrate P2 to neutralize positive charges thereof is also slow, so that the adhesion speed of the toner (+) to the surface of a negatively charged photoconductive layer P1 be slow and the master is sometimes conveyed to a next step with toner-nonadhered area left.

In the case of an image which needs adhesion of a toner to a large area such as picture or pattern, in particular, the master is often conveyed to a next step while uniform formation of a so called solid image is not carried out, since when the master P is passing through the developing step, the toner adheres to only a part of the photoconductive layer P1 opposite to a part of the substrate P2 neutralized by adhesion of negative ions and does not adhere to all over the above described large area.

In this developing system, furthermore, the toner (+) gradually adheres to the electrode (−) 11 facing the substrate P2 to lower the developing performance and consequently, it is required to periodically clean the electrode 11.

In order to further solve the above described problems, the inventors have proposed a liquid developing method of direct feed system in which development is carried out by using an elastic conductor 12 such as hardened steel with a diameter of about 0.1 mm as shown in FIG. 2 instead of the above described electrode 11 of the prior art, contacting the conductor 12 with a substrate P2 of a master P, optionally changing a switch and applying a voltage to between the conductor 12 and an electrode 10 from an external power source and directly feeding electrons from the conductor 12 to the substrate P2 (Japanese Patent Application No. 89373/1988).

According to this direct feed system, positive charges on the surface of the substrate P2 are rapidly and surely neutralized with the electrons directly fed from the conductor 12, so that adhesion of toners to the surface of a photoconductive layer P1 can rapidly and surely be carried out and formation of a so-called solid part can uniformly and finely be carried out. In addition, other processings are not required than flowing of a developing liquid DL between the photoconductive layer P1 and electrode 10 and accordingly, the toners (+) do not adhere to the conductor 12.

In the case of the above described direct electron injection system, however, if the substrate P2 has a high electric resistance, electrons cannot directly be fed from the conductor 12 and therefore, it is necessary that the substrate 12 has some electric conductivity.

Of course, in the developing system of the prior art as shown in FIG. 3, if the electric conductivity of the substrate P2 is high to some extent, the neutralization speed of negative ions in the developing liquid DL and positive charges on the surface of the substrate P2 is somewhat increased. Therefore, it is of important significance to decrease the resistance of the substrate P2 in the field of liquid development and this is adapted to not only the above described direct electron injection system but also the prior art developing system. Furthermore, for the purpose of, during imagewise exposure, neutralizing negative charges on an exposed area of the photoconductive layer P1 with positive charges on the surface of the substrate P2 through the interior of the substrate P2, it is important that the substrate P2 has a low electric resistance.

In order to decrease the electric resistance of the substrate P2, it is necessary to render electrically conductive a paper base itself for composing the substrate P2 by adding thereto an electrically conductive material or to decrease the resistance of a coated layer such as of polyethylene provided on one or both surfaces of a paper base to lower the permeability of water as described above by adding an electrically conductive material to the coated layer.

In the case of the coated layer (hereinafter referred to as "undercoated layer") provided on the photoconductive layer side of a paper base, however, an excessively low resistance results in pinholes (spark mark caused by discharge, to which toners do not adhere) and accordingly, it is required that the undercoated layer has at least some surface resistivity. On the other hand, a back layer has no concern for this, and it is not necessary to specify the lower limit of the surface resistivity.

SUMMARY OF THE INVENTION

It is an object of the present invention to provide an electrophotographic lithographic printing plate or master suitable for not only the ordinary developing methods but also the developing methods of direct electron injection system.

It is another object of the present invention to provide an electrophotographic lithographic printing plate precursor or master capable of obtaining pinhole-free image.

It is a further object of the present invention to provide an electrophotographic lithographic printing plate precursor having an undercoated layer and back layer, each having an optimum surface resistivity.

It is a still further object of the present invention to provide a method of developing the above described master.

These objects can be attained by an electrophotographic lithographic printing plate precursor comprising an electrically conductive base coated, on one side thereof, with an undercoated layer and a photoconductive layer containing zinc oxide as a predominant component in order and, on the opposite side thereof, with a back layer, said undercoated layer having a surface resistivity of $1\times10^{8}$ to $1\times10^{14}\Omega$ and said back layer having a surface resistivity of at most $1\times10^{10}\Omega$, and a method of developing the electrophotographic lithographic printing plate precursor comprising arranging an electrode to face the photoconductive layer, supplying a developing liquid to between the electrode and photoconductive layer, contacting a conductor with the back layer, optionally applying a voltage between the conductor and electrode and thereby carrying out liquid development.

BRIEF DESCRIPTION OF THE DRAWINGS

The accompanying drawings are to illustrate in detail the principle and merits of the present invention.

DETAILED DESCRIPTION OF THE INVENTION

Figure 1:
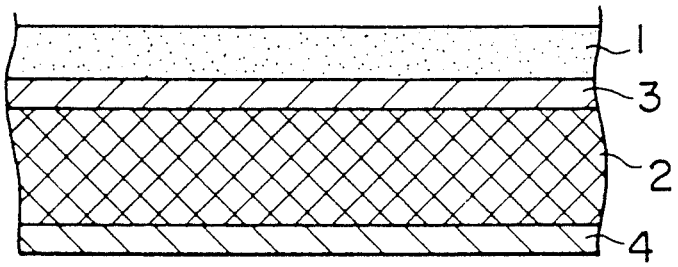
FIG. 1 is a cross-sectional view of one embodiment of a master according to the present invention.

The master of the present invention comprises a photoconductive layer 1, and electrically conductive base 2, an undercoated layer 3 provided on one side of the base 2 and a back layer 4 provided on the opposite side thereof, as shown in FIG. 1.

The undercoated layer 3 has a surface resistivity of $1\times10^{8}\Omega$ to $1\times10^{14}\Omega$ and the back layer 4 has a surface resistivity of $1\times10^{10}\Omega$ or less, whereby the following effects or performances are given:

(i) During exposure after statically charging, negative charges on exposed areas of the photoconductive layer 1 rapidly pass through the undercoated layer 3 and base 2 and neutralize positive charges on the surface of the back layer 4.

(ii) Since the electric conductivity of the back layer 4 is considerably high as described above, positive charges on the back layer 4 are rapidly and correctly neutralized during development, resulting in uniform and correct formation of a so-called solid image free from pinholes.

(iii) According to the developing method by direct electron injection system of the present invention, in particular, electrons directly fed from a conductor rapidly flow in the back layer 4 having a considerably high electric conductivity and the neutralization of positive charges of the back layer 4 can correctly be carried out at a high speed.

If the surface resistivity of the undercoated layer 3 exceeds $1\times10^{14}\Omega$, flow of charges is hindered and the above described effect (i) cannot be obtained, while if less than $1\times10^{8}\Omega$, pinholes occur. If it is in the range of $1\times10^{10}$ to $1\times10^{13}\Omega$, the above described effects can surely be obtained to yield better results.

On the other hand, if the surface resistivity of the back layer 4 exceeds $1\times10^{10}\Omega$, flow of charges is hindered and the above described effects (ii) and (iii) cannot be obtained.

In the present invention, the above described undercoated layer 3 and back layer 4 can be formed by the ordinary lamination or coating method. That is, in the case of the lamination method, an electrically conductive material is incorporated in a matrix resin and then subjected to lamination in conventional manner, while in the case of the coating method, an electrically conductive material is incorporated in a matrix resin dissolved in a solvent and then subjected to coating in conventional manner.

As the above described matrix resin, there can be used $\alpha$-polyolefins typical of which are polyethylene, polypropylene and ethylene-butene copolymers. Above all, polyethylene is practically used.

As this polyethylene, there can preferably be used those having a density of 0.92 to 0.96 g/cc, melt index of 1.0 to 30 g/10 min, average molecular weight of 20,000 to 50,000, softening point of 110° to 130° C. and tensile strength of 130 to 300 kg/cm$^2$. More preferably, a composition is used comprising 10 to 90% by weight of low density polyethylene having a density of 0.915 to 0.930 g/cc and a melt index of 1.0 to 30 g/10 min and 90 to 10% by weight of high density polyethylene having a density of 0.940 to 0.970 g/cc and a melt index of 1.0 to 30 g/10 min.

This composition is capable of providing a normal and homogeneous heat resisting laminated layer, in which an electron conductive material hereinafter described can be dispersed in such a manner that electric current readily flows.

The solvent used in the coating method should suitable be chosen depending on the variety of the matrix resin.

Examples of the electron conductive material are metal oxides of zinc, magnesium, tin, barium, indium, molybdenum, aluminum, titanium, silicon and the like, preferably fine particles of crystalline oxides or mixed oxides thereof, and carbon blacks (French Patent No.

2,277,136 and U.S. Pat. No. 3,597,272). Above all, electrically conductive carbon blacks are preferably used because of giving electric conductivity with a small amount and being compatible with various matrix resins.

The quantity of the electron conductive material to be used, depending on the kinds of the matrix resin and electron conductive material, cannot unconditionally be determined, but should generally be adjusted so as to give the above described surface resistivity of each of the undercoated layer 3 and back layer 4. Preferably, it is 0 to 20% by weight in the case of the undercoated layer 3 and 3 to 15% by weight in the case of the back layer 4.

The thickness of the undercoated layer 3 or back layer 4 is generally in the range of 5 to 50 μm, preferably 10 to 30 μm, since if too thin, the waterproofness is insufficient, while if too thick, its effect is not increased for the thickness.

For the purpose of improving the bonding strength between the undercoated layer 3 or back layer 4 and the base 2, when the base 2 is an electrically conductive paper base, it is preferable to coat the paper 2 with a polyethylene derivative such as ethylene-vinyl acetate copolymer, ethylene-acrylic acid ester copolymer, ethylene-methacrylic acid ester copolymer, ethylene-acrylic acid ester, ethylene-methacrylic acid copolymer, ethylene-acrylonitrile-acrylic acid copolymer or ethylene-acrylonitrile-methacrylic acid copolymer, or to subject the surface of the paper 2 to a corona discharge treatment. Furthermore, the paper 2 can also be subjected to various surface treatments such as described in Japanese Patent Laid-Open Publication Nos. 24126/1974, 36176/1977, 121683/1977, 2612/1978, 111331/1979 and Japanese Patent Publication No. 25337/1976.

In the present invention, as the paper 2, there are used electrically conductive base papers commonly used for electrophotographic light-sensitive materials, for example, papers impregnated with the above described electron conductive materials, papers to which the electron conductive materials have been added during paper making and synthetic papers described in Japanese Patent Publication Nos. 4239/1977, 19031/1978 and 19684/1978. Above all, it is desirable to use those having a basis weight of 50–250 g/m$^2$, preferably 50–200 g/m$^2$ and thickness of 50 to 250 μm.

In the present invention, the photoconductive layer 1 comprises a photoconductive material and a binder. Examples of the photoconductive material are inorganic photoconductive materials such as zinc oxide, cadmium sulfide and titanium oxide and organic photoconductive materials such as phthalocyanine dye. Examples of the binder are silicone resins, polystyrene, polyacrylates, polymethacrylates, polyvinyl acetate, polyvinyl chloride, polyvinyl butyral and derivatives thereof. The ratio of the photoconductive material and binder is preferably in the range of 3:1 to 20:1 by weight. If necessary, sensitizers and coating aids used for coating can be added. The photoconductive layer 1 has a thickness of preferably 5 to 30 μm.

For the purpose of improving the bonding strength between the photoconductive layer 1 and undercoated layer 3, it is preferable to previously subject the surface of the undercoated layer 3 to surface treatments such as corona discharge treatment, glow discharge treatment, flame treatments, ultraviolet ray treatment, ozone treatment, plasma treatment and the like, as disclosed in U.S. Pat. No. 3,411,908.

Figure 2:
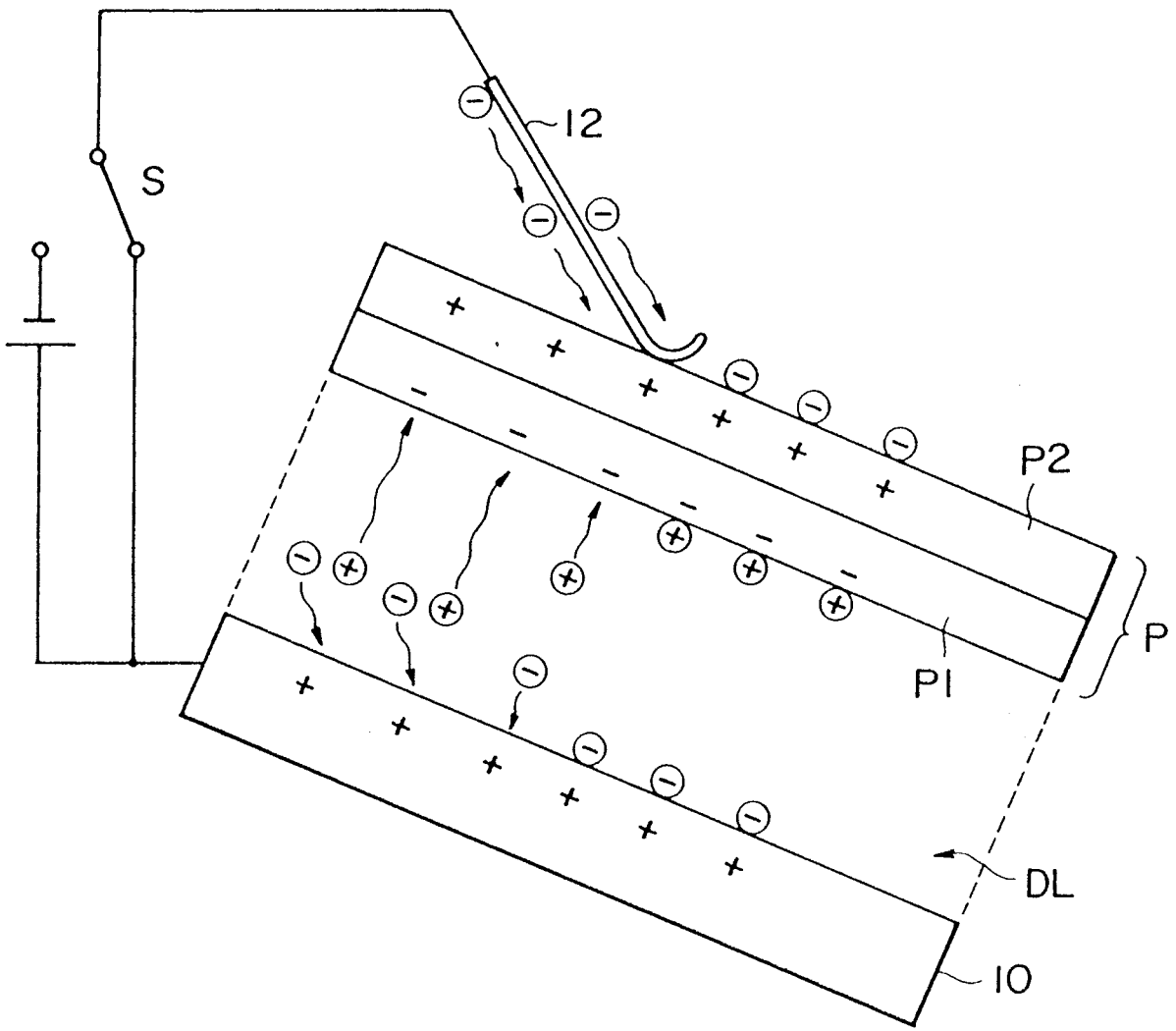
FIG. 2 is a schematic view to show the principle of a liquid development by direct feed system according to the present invention.
Figure 3:
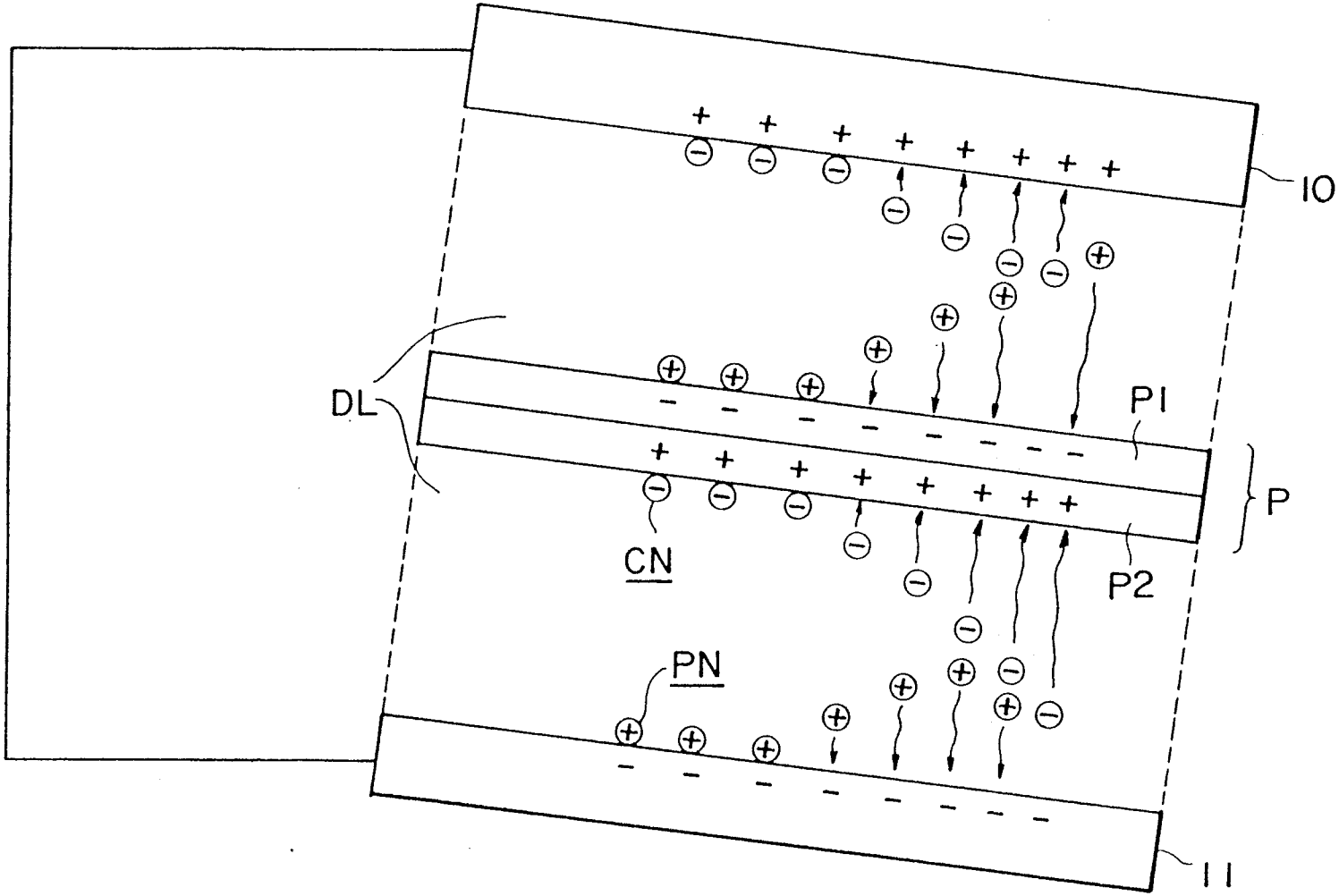
FIG. 3 is a schematic view to show the principle of a liquid development of the prior art.

The master of the present invention, as illustrated above, is converted into a lithographic printing plate through the ordinary steps of statically charging, imagewise exposing and developing. During the same time, the development can be carried out by not only the liquid developing method of the prior art as shown in FIG. 3, but also the developing method of the present invention, based on the principle of the liquid developing method of direct feed system as shown in FIG. 2, the inventors have previously proposed in the prior patent application. The latter method is more preferable.

In the developing method of the present invention, the conductor 12 of FIG. 2 is brought into contact with the above described back layer 4 and the photoconductive layer 1 is allowed to face the electrode 10 of FIG. 2, or a switch S is changed and a voltage is applied to between the electrode 10 and conductor 12 so that the electrode 10 becomes a positive electrode and the conductor 12 becomes a negative electrode. If necessary, the back layer 4 is electrically grounded through the conductor 12.

The positive charges on the surface of the back layer 4, which have not been neutralized and remained in the step of imagewise exposing, are thus neutralized rapidly with electrons directly fed from the conductor 12 or earth, so that toners (+) rapidly adhere to the photoconductive layer 1 (−) and are neutralized.

Thus, a uniform solid image can be formed without formation of toner-non-adhered areas.

It will clearly be understood from the foregoing detailed illustration that according to the present invention, the surface resistivities of the undercoated layer and back layer provided on both the surfaces of an electrically conductive base are respectively maintained optimum and consequently, the neutralization speed of negative ions (charge controlling agent) in a developing liquid or electrons directly fed to the back layer with positive charges on the surface of the back layer is increased so that the liquid development can be carried out correctly, finely and rapidly in both the cases of the development of the prior art and that of the direct electron injection system. Thus, even in a so-called solid part, a pinhole-free good image can be obtained.

Since during imagewise exposure, negative charges on exposed areas of the photoconductive layer rapidly pass through the undercoated layer, electrically conductive base and back layer and are rapidly neutralized with positive charges on the surface of the back layer, furthermore, the imagewise exposure can also be carried out correctly, finely and rapidly.

Since in the present invention, development is carried out by directly injecting electrons to the back layer, neutralization of charges on the layer can rapidly and correctly be carried out and consequently, adhesion of toners to the photoconductive layer can well be forwarded, thus rendering it possible to form a uniform solid image.

According to the present invention, therefore, an electrophotographic lithographic printing plate precursor or master can be obtained with excellent properties.

The present invention will now be illustrated in greater detail by way of examples, but it should be understood that the present invention is not limited thereto. In these examples, parts and percents are to be taken as those by weight unless otherwise indicated.

EXAMPLE 1

A fine quality paper with a basis weight of 100 g/m$^2$ was coated with a 5% aqueous solution of calcium chloride to give an amount of 20 g/m$^2$ and dried to obtain an electrically conductive base paper 2 as shown in FIG. 1.

The undercoated layer 3 side and back layer 4 side of the resulting electrically conductive paper base 2 were coated with 10 kinds of coating dispersions having the following compositions to give a dry coverage of 10 g/m$^2$ and surface resistivity as shown in Table 1, thus preparing 100 kinds of the masters of the present invention.

| Composition of Coating Dispersion for Controlling Surface Resistivity | |
|---|---|
| Styrene Butadiene Latex (solid content: 50%) | 100 parts |
| Carbon Black | 0-10.5 |
| Clay (aqueous dispersion with solid content of 45%) | 100 |
| Water | 35 |

TABLE 1

| Coating Dispersion | Amount of Carbon Black Added (parts) | Surface Resistivity of coated and Dried Surface (Ω) |
|---|---|---|
| A | 0 | $2.5 \times 10^{14}$ |
| B | 2 | $2.3 \times 10^{13}$ |
| C | 4.5 | $3.4 \times 10^{12}$ |
| D | 7 | $2.1 \times 10^{11}$ |
| E | 8 | $1.0 \times 10^{10}$ |
| F | 8.5 | $6.7 \times 10^{9}$ |
| G | 9 | $1.8 \times 10^{9}$ |
| H | 9.5 | $9.1 \times 10^{8}$ |
| I | 10 | $2.4 \times 10^{8}$ |
| J | 10.5 | $3.5 \times 10^{7}$ |

The undercoated layer 3 was coated with the following coating composition to give a dry coverage of 20 g/m$^2$ and dried to form the photoconductive layer 1.

| | Parts |
|---|---|
| Photoconductive Zinc Oxide (Sazex 2000 -commercial name- made by Sakai Kagaku Kogyo KK) | 100 |
| Silicone Resin (KR-211 -commercial name- made by Shinetsu Kagaku KK) | 35 |
| Rose Bengal | 0.1 |
| Fluorescein | 0.2 |
| Methanol | 10 |
| Toluene | 150 |

The thus obtained samples of electrophotographic lithographic printing plate precursor or master were subjected to statically charging, imagewise exposing and then liquid developing by the direct feed system using a test device based on the principle of FIG. 2, in which the conductor 12 of hardened steel with a diameter of 0.1 mm was contacted with the back layer 4 and the switch S being changed, the conductor 12 and electrode 10 were directly combined without using an external power source.

As an exposure image, there was used a copy pasted, at the center thereof, with a black sheet of 185 mm×257 mm (B5 size) so as to examine the uniformity of a solid part as one object of the present invention. A series of the resulting lithographic printing plate samples were then subjected to examination of the uniformity of the solid part, pinholes in the image and durability, thus obtaining results as shown in Table 2.

The printing durability was judged by the fog in the solid part after printing 3000 sheets under standard printing conditions using an offset printing machine, Hamada 800 SX (commercial name).

TABLE 2

| Solid Density / Pinholes | Printing Durability / Fog | Back Layer 4 | | | | | | | | | |
|---|---|---|---|---|---|---|---|---|---|---|---|
| | | A | B | C | D | E | F | G | H | I | J |
| Undercoated Layer 3 | A | xx | xx | xx | ΔΔ | oo | oo | oo | oo | oo | oo |
| | | ox | ox | ox | ox | oΔ | oΔ | oΔ | oΔ | oΔ | oΔ |
| | B | xx | xx | xx | ΔΔ | oo | oo | oo | oo | oo | oo |
| | | ox | ox | ox | oΔ | oo | oo | oo | oo | oo | oo |
| | C | xx | xx | xx | ΔΔ | oo | oo | oo | oo | oo | oo |
| | | ox | ox | ox | oΔ | oo | oo | oo | oo | oo | oo |
| | D | xx | xx | xx | ΔΔ | oo | oo | oo | oo | oo | oo |
| | | ox | ox | ox | oΔ | oo | oo | oo | oo | oo | oo |
| | E | xx | xx | xx | ΔΔ | oo | oo | oo | oo | oo | oo |
| | | ox | ox | ox | oΔ | oo | oo | oo | oo | oo | oo |
| | F | xx | xx | xx | ΔΔ | oo | oo | oo | oo | oo | oo |
| | | ox | ox | ox | oΔ | Δo | Δo | Δo | Δo | Δo | Δo |
| | G | xx | xx | xx | ΔΔ | oo | oo | oo | oo | oo | oo |
| | | ox | ox | ox | oΔ | Δo | Δo | Δo | Δo | Δo | Δo |
| | H | xx | xx | xx | ΔΔ | oo | oo | oo | ΔΔ | oo | oo |
| | | ox | ox | ox | oΔ | Δo | Δo | xo | xo | xo | xo |
| | I | xx | xx | xx | ΔΔ | oo | oo | oo | oo | ΔΔ | ΔΔ |
| | | ox | ox | ox | oΔ | Δo | Δo | xo | xo | xo | xo |
| | J | xx | xx | xx | ΔΔ | oo | oo | oo | oo | ΔΔ | ΔΔ |
| | | ox | ox | ox | oΔ | Δo | Δo | xo | xo | xo | xo |

In Table 2, oΔx at the left side shows the presence of pinholes in the solid density and oΔx at the right side shows the presence of fog for the printing durability.

The definition of oΔx of pinholes is as follows:

o: no pinhole

Δ: 0 to 10 pinholes/m$^2$ x: more than 10 pinholes/m$^2$

The definition of oΔx of fog is as follows:

o: less than 0.06 by reflection density

Δ: 0.06 to 0.09 by reflection density x: more than 0.09 by reflection density

It is apparent from Table 2 that in order to obtain properties having no problem as to any of solid density, printing durability, pinhole and fog by the direct feed system, it is required to specify the surface resistivity of the undercoated layer 3 in $1\times10^8$ to $1\times10^{14}\Omega$, preferably $1\times10^{10}$ to $1\times10^{13}\Omega$ and that of the back layer 4 in at most $1\times10^{10}\Omega$.

What is claimed is:

1. An electrophotographic lithographic printing plate precursor comprising an electrically conductive base coated, on one side thereof, with an undercoated layer and a photoconductive layer containing zinc oxide as a predominant component in order and, on the opposite side thereof, with a back layer, said undercoated layer having a surface resistivity of $1\times10^8$ to $1\times10^{14}\Omega$ and said back layer having a surface resistivity of at most $1\times10^{10}\Omega$.

2. The electrophotographic lithographic printing plate precursor as claimed in claim 1, wherein the undercoated layer or back layer comprises an electron conductive material in a matrix resin.

3. The electrophotographic lithographic printing plate precursor as claimed in claim 2, wherein the matrix resin is an α-polyolefin.

4. The electrophotographic lithographic printing plate precursor as claimed in claim 3, wherein the α-polyolefin is selected from the group consisting of polyethylene, polypropylene and ethylene-butene copolymers.

5. The electrophotographic lithographic printing plate precursor as claimed in claim 4, wherein the polyethylene is one having a density of 0.9 to 0.96, a melt index of 1 to 30 g/10 min, an average molecular weight of 20,000 to 50,000, a softening point of 110° to 130° C. and a tensile strength of 130 to 300 kg/cm$^2$.

6. The electrophotographic lithographic printing plate precursor as claimed in claim 4, wherein the polyethylene is used in the form of a mixture of 10 to 90% by weight of a low density of polyethylene having a density of 0.915 to 0.930 and a melt index of 1 to 30 g/10 min and 90 to 10% by weight of a high density polyethylene having a density of 0.940 to 0.970 and a melt index of 1 to 30 g/10 min.

7. The electrophotographic lithographic printing plate precursor as claimed in claim 2, wherein the electron conductive material is in a proportion of 0 to 20% by weight in the undercoated layer.

8. The electrophotographic lithographic printing plate precursor as claimed in claim 2, wherein the electron conductive material is in a proportion of 3 to 15% by weight in the back layer.

9. The electrophotographic lithographic printing plate precursor as claimed in claim 2, wherein the undercoated layer or back layer has a thickness of 5 to 50 μm.

10. The electrophotographic lithographic printing plate precursor as claimed in claim 2, wherein the electron conductive material is selected from the group consisting of metal oxide fine particles of zinc, magnesium, tin, barium, indium, molybdenum, aluminum, titanium and silicon, fine particles of crystalline metal oxides and mixed metal oxides thereof and carbon blacks.

11. The electrophotographic lithographic printing plate precursor as claimed in claim 1, wherein the base is an electrically conductive paper.

12. The electrophotographic lithographic printing plate precursor as claimed in claim 11, wherein the electrically conductive paper is subjected to a pretreatment before the lamination of the undercoated layer or back layer.

13. The electrophotographic lithographic printing plate precursor as claimed in claim 12, wherein the pretreatment is a corona discharge treatment.

14. The electrophotographic lithographic printing plate precursor as claimed in claim 12, wherein the pretreatment is carried out by coating a polyethylene derivative selected from the group consisting of ethylene-vinyl acetate copolymers, ethylene-acrylic acid ester copolymers, ethylene-methacrylic acid ester copolymers, ethylene-acrylic acid copolymers, ethylene-methacrylic acid copolymers, ethylene-acrylonitrile-acrylic acid copolymers and ethylene-acrylonitrile-methacrylic acid copolymers.

15. The electrophotographic lithographic printing plate precursor as claimed in claim 1, wherein the photoconductive layer consists of a binder and photoconductive material.

16. The electrophotographic lithographic printing plate precursor as claimed in claim 15, wherein the binder is selected from the group consisting of silicone resins, polystyrene, polyacrylic acid esters, polymethacrylic acid esters, polyvinyl acetate, polyvinyl chloride, polyvinyl butyral and derivatives thereof.

17. The electrophotographic lithographic printing plate precursor as claimed in claim 15, wherein the photoconductive material is an inorganic photoconductive material selected from the group consisting of zinc oxide, cadmium sulfide and titanium oxide.

18. The electrophotographic lithographic printing plate precursor as claimed in claim 15, wherein the binder and photoconductive material are in a proportion of 3:1 to 20:1 by weight.

19. The electrophotographic lithographic printing plate precursor as claimed in claim 1, wherein the photoconductive layer has a thickness of 5 to 30 μm.

20. A method of developing the electrophotographic lithographic printing plate precursor as claimed in claim 1, which comprises arranging an electrode to face the photoconductive layer, supplying a developing liquid to between the electrode and photoconductive layer, contacting a conductor with the over back layer, optionally applying a voltage to between the conductor and electrode and thereby carrying out liquid development.

* * * * *